US005474702A

United States Patent [19]

Egraz et al.

[11] Patent Number: 5,474,702

[45] Date of Patent: Dec. 12, 1995

[54] STABLE AQUEOUS SUSPENSIONS OF ZEOLITES, METHODS OF PRODUCING SAME, AND USE OF THE SUSPENSIONS

[75] Inventors: Jean-Bernard Egraz, Ecully; Henri Grondin; Jean-Marc Suau, both of Lyons, all of France

[73] Assignee: Coatex, S.A., Genay, France

[21] Appl. No.: 354,811

[22] Filed: Dec. 8, 1994

Related U.S. Application Data

[62] Division of Ser. No. 83,255, Jun. 29, 1993.

[30] Foreign Application Priority Data

Jul. 1, 1992 [FR] France ..... 92 08398

[51] Int. Cl.$^6$ ..... C11D 3/08; C11D 3/37

[52] U.S. Cl. ..... 252/174.25; 252/174; 252/23; 252/174.24; 252/174.21; 252/140; 252/525; 252/527; 252/DIG. 2; 526/318.41; 526/318.43; 526/318.44

[58] Field of Search ..... 252/174.23, 174.24, 252/525, 527, DIG. 2, 140, 174.21, 174.25; 526/318.41, 318.43, 318.44

[56] References Cited

U.S. PATENT DOCUMENTS

| | | | |
|---|---|---|---|
| 4,547,306 | 10/1985 | Hase et al. | 252/99 |
| 5,273,676 | 12/1993 | Boeckh et al. | 252/174.21 |
| 5,409,629 | 4/1995 | Shulman et al. | 252/174.23 |

*Primary Examiner*—Paul Lieberman
*Assistant Examiner*—Wyatt B. Pratt
*Attorney, Agent, or Firm*—Oblon, Spivak, McClelland, Maier, & Neustadt

[57] ABSTRACT

A stable aqueous zeolite suspension containing, as stabilizing agent, a copolymer comprising units of (i) at least one acrylic monomer having a carboxylic acid group, (ii) at least one acrylic and/or vinyl monomer not having a carboxylic acid group, and (iii) at least one oxyalkylated monomer having ethylenic unsaturation, and terminated by a fatty hydrophobic chain having 12–40 C atoms.

5 Claims, No Drawings

STABLE AQUEOUS SUSPENSIONS OF ZEOLITES, METHODS OF PRODUCING SAME, AND USE OF THE SUSPENSIONS

This is a Division, of application Ser. No. 08/083,255 filed on Jun. 29, 1993.

BACKGROUND OF THE INVENTION

1. Field of the Invention

The present invention relates to stable aqueous suspensions, of silica-aluminates known as zeolites, which suspensions also have good fluidity.

2. Description of the Background

The zeolites are increasingly used in detergent formulations as replacements for polyphosphates, which, when discharged into the environment, are responsible for eutrophication of lakes and rivers.

To facilitate the use of zeolites during the production of detergent formulations, zeolites are increasingly employed in the form of c. 50% aqueous suspensions of anhydrous zeolite. These suspensions must then be employable in industry; i.e. they must be pumpable after being transported from the production location to the utilization location, and/or after storage for several days prior to utilization.

Over a long time, various adjuvants have been proposed which enable production of stable suspensions of zeolites. Thus, Fr. Pat. 2,287,504 and Eur. Pat. 0,294,694 describe the preparation of suspensions of zeolites stabilized with surfactants belonging particularly to the family of fatty alcohols with 10–18 C atoms ethoxylated with 1–8 moles of ethylene oxide. This solution has the drawback of requiring the use of large quantities on the order 0.5–6%, on the basis of the total weight of the suspension, of the stabilizing agent.

Fr. Pat. 2,512,690, discloses the stabilizing agents which are hydroxylated polymers which are starch derivatives. These have been found to be efficacious, but must be used in large quantities, amounting to 0.4–2.5 wt. %, based on the total weight of the suspension.

Ger. Pat. 3,021,295 describes a stable composition of zeolites containing 15% of nitrilotriacetic acid in salt form. The discharge of wastes containing this product is strictly regulated at present, and in certain countries is prohibited.

Ft. Pats. 2,455,479 and 2,461,516 claim stabilizers in the form of polymers which have the drawback of causing the release of ammonia in the strongly alkaline medium (pH 10–13) of the zeolites in the case of Fr. 2,455,479, and in the case of Fr. 2,461,516, the drawback is lack of assurance of good stability during the preparation, storage, and shipping of the zeolite suspensions when temperatures are in the range 50°–60° C.

Fr. Pat. 2,658,095 describes the use of crosslinked acrylic copolymers as stabilizing agents. This solution also has the drawback of requiring excessive amounts of stabilizer the order of 0.4 wt. % on dry basis, based on the total weight of the suspension. A need continues to exist for aqueous zeolite suspensions of improved fluidity and stability characteristics.

SUMMARY OF THE INVENTION

Accordingly, one object of the invention is the preparation of an aqueous zeolite suspension which is stable over time, has good fluidity, and contains one or more natural or synthetic zeolites and water Another object of the present invention is to provide aqueous suspensions of zeolites comprising the stabilizing agent of the invention, in the area of technology of detergents and detergency, and as sequestering agents.

Briefly these and other objects of the present invention as hereinafter will become more readily apparent can be attained by an aqueous zeolite suspension containing a stabilizing agent, in addition to one or more natural or synthetic zeolites, which is comprised of:

(a) units of at least one acrylic monomer having a carboxylic acid group selected from the group consisting of (meth)acrylic, itaconic, cinnamic, crotonic, isocrotonic, fumaric, and maleic acids and maleic anhydride, and the aconitic, mesaconic, sinapic, undecylenic, angelic, and hydroxyacrylic acids, and derivatives thereof;

(b) units of at least one acrylic and/or vinylic monomer not having a carboxylic acid group selected from the group consisting of
the esters, amides, and/or nitriles of (meth)acrylic, itaconic, cinnamic, crotonic, isocrotonic, fumaric, maleic, aconitic, mesaconic, sinapic, undecylenic, angelic, and hydroxyacrylic acids, and derivatives thereof, and
vinyl acetate, styrene, α-methylstyrene, diisobutylene, vinylpyrrolidone, and vinylcaprolactam; and (c) units of at least one oxyalkylated monomer having ethylenic unsaturation and terminated by a hydrophobic chain having formula I $$R\left(\left(CH_2-\underset{\underset{R_1}{|}}{CH}-O\right)_m\left(CH_2-CH_2-O\right)_n\left(CH_2-\underset{\underset{R_2}{|}}{CH}-O\right)_p\right)_q-R' \quad (I)$$

where m and p represent the numbers of oxyalkylene groups;

n represents the number of oxyethylene groups;

q represents a number of at least equal to 1 such that $q(n+m+p) \leqq 100$;

R represents an unsaturated polymerizable group;

R' represents an hydrophobic group with a fatty chain;

$R_1$ represents hydrogen or a methyl group; and $R_2$ represents hydrogen or a methyl group.

DETAILED DESCRIPTION OF THE PREFERRED EMBODIMENTS

The discovery of the present invention is aqueous zeolite suspensions which have fluidity and storage stability which are, surprisingly, substantially improved as a result of the use of water-soluble, non-crosslinked acrylic copolymers, which copolymers are employed in amounts much lower than with products known to the art. On the other hand, in the art, an aqueous zeolite suspension is stabilized by means of agents such as surfactants, complexers, or crosslinked acrylic polymers. Suitable zeolites which can be employed include types 4A, X and Y zeolites.

In a preferred embodiment of the present invention an aqueous zeolite suspension at a zeolite concentration of about 50% (as anhydrous zeolite) is provided, the suspension containing as a water-soluble stabilizing agent, a copolymer comprised of:

(a) units of at least one acrylic monomer having a carboxylic acid group, more specifically selected from the group consisting of (meth)acrylic acids, preferably in the amount of 15–75 wt. %, on the basis of the total weight of the monomers, particularly preferably 20–50 wt. %;

(b) units of at least one acrylic monomer, more specifically selected from the group consisting of esters, amides, and/or nitriles of the (meth)acrylic acids, preferably in the amount of 23–83 wt. %, based on the total weight of the monomers, particularly preferably in the amount of 47–77 wt. %; and (c) units of at least one oxyalkylated monomer having ethylenic unsaturation and terminated by a hydrophobic chain having formula I $$R\left[\left(CH_2-\underset{R_1}{\underset{|}{CH}}-O\right)_m\left(CH_2-CH_2-O\right)_n\left(CH_2-\underset{R_2}{\underset{|}{CH}}-O\right)_p\right]_q-R' \quad (I)$$

preferably in the amount of 2–12 wt. % based on the total weight of the monomers, particularly preferably 3–12 wt. %;

where, in formula I, m and p represent the numbers of oxyalkylene groups, each$\leqq$100;

n represents the number of oxyethylene groups$\leqq$100;

q represents a number at least equal to 1, such that $q(n+m+p)\leqq 100$;

$R_1$ represents hydrogen or a methyl group;

$R_2$ represents hydrogen or a methyl group; and

R represents an unsaturated polymerizable group selected from the group consisting of vinyl group containing moieties, methacryloyl, maleoyl, itaconoyl, crotonoyl, an unsaturated urethane moiety, hemiester maleoyl, hemiester itaconoyl, $CH_2{=}CHCH_2{-}O{-}$, methacrylamido and substituted methacrylamido; and R' represents a hydrophobic group with a fatty chain, said group being, e.g., an alkyl group, an alkylaryl group, an aralkyl group, or an aryl group, having 12–40 C atoms, preferably 26–40 C atoms, linear or branched.

The vinyl group containing moiety of R is preferably member selected from the group consisting of acryloyl, a vinylphthaloyl, a hemiester phthaloyl, acrylamido and a substituted acrylamido, and the unsaturated urethane moiety is preferably (meth) acrylurethane, α,α-dimethyl-m-isopropenylbenzylurethane or allylurethane.

This copolymer, employed in an aqueous zeolite suspension of the invention is obtained by methods known to one skilled in the art, employing radical polymerization, in direct or inverse emulsion, in suspension, or employing precipitation in an appropriate solvent.

The copolymer thus prepared enables one to obtain, according to the invention, an aqueous zeolite suspension which has good fluidity and stability, i.e., fluid and stable, and which has a zeolite content of c. 50% and an anhydrous zeolite basis.

The suspension, according to the invention, may be obtained by simple mixing of the water-soluble copolymer into the non-stabilized aqueous zeolite suspension. The suspension, may also be obtained from a previously dried powder of the zeolite, which may be advantageous if the silicoaluminate is produced at a geographic distant from the utilization site, wherewith the cost of shipping it dry is less than the cost of drying.

The aqueous suspension according to the invention during the process of production of zeolite itself, namely by reaction between the filter cake and the water-soluble copolymer, which copolymer is added following the stage of washing and filtration.

The aqueous zeolite suspension according to the invention, obtained, as described, by the use of up to 0.3 wt. % of the water-soluble copolymer (as dry copolymer, and based on the total weight of the suspension) has an apparent Brookfield viscosity of <2500 mPa-s (or cp) at 10 rpm and 20° C., and shows no change therein after 40 days storage without agitation.

The tendency of the suspension not to sediment, and its pumpability and handability, are expressed by (i) the measured height of the sediment at the bottom of the suspension following storage 4 days at ambient temperature, and (ii) the Brookfield viscosity after storage 40 days at ambient temperature.

These tests enable one to classify the various aqueous zeolite suspensions of, which classification demonstrates that the aqueous zeolite suspension of the invention is particularly stable, fluid, pumpable, and manipulable. These properties are not changed by temperatures up to 60° C., even after storage for several days in non-agitated tanks or after shipping in customary tank trucks or railroad tank cars.

The aqueous zeolite suspension of the invention also has the advantage of being more pure than those known in the art, because the amount of stabilizing agent employed is less, and its complexing power is preserved, thereby enabling its use as a sequestering agent.

The high stability of the aqueous zeolite suspension of the invention enables them to be used in detergent applications without further transformation, by mixing in with other additives of the detergent. If the aqueous zeolite suspension of the invention is employed in detergent formulations in pulverulent form following drying, e.g. by spray drying or dry spraying, it is noted that the products obtained are free from dust.

Having generally described this invention, a further understanding can be obtained by reference to certain specific examples which are provided herein for purposes of illustration only and are not intended to be limiting unless otherwise specified.

EXAMPLE 1

To prepare the aqueous zeolite suspensions stabilized by various stabilizing agents, for all of the tests the same aqueous zeolite (type 4A) suspension containing 52.5% of zeolites (dry zeolites basis), was used.

The suspension appeared very fluid when kept agitated. In the absence of a stabilizing agent it sedimented in several hours, and separated into two phases of a liquid supernatant and a second phase leading to a very hard sediment which was impossible to resuspend without powerful mechanical means.

The zeolite particles are of 1–10 micron sizes, and the suspension had an alkaline pH>12.

Method:

The suspension is divided into test samples of 240 g. Each sample was preserved in a 230 ml glass bottle having a hermetically sealing metal cover. Each bottle is used in only one stabilization test. For each test, the contents of the bottle are converted into a suspension which is fluid and homogeneous, with the aid of a system of agitation of the Rayneri type, prior to adding the stabilizer to be tested. The agitation is maintained 15 min, so as to obtain an intimate mixture of the suspension to be stabilized and the stabilizer being tested.

After this time, the rheology of the system is determined with the aid of a type RVT Brookfield viscosimeter, equipped with a suitable module. The apparent viscosity $T_0$ was measured at 20° C. Readings are taken at 10 rpm and 100 rpm, following 2 min of rotation in each case. The hermetic covers are affixed to the containers of suspension thus stabilized, and the containers are allowed to "age" statically at ambient temperature for 4 days.

After this interval, the stability and rheology of the suspension were determined.

a. Stability:

Stability is determined by measuring the height of the sediment at the bottom of the glass bottle, with the aid of a graduated probe. The aqueous suspension of zeolite is regarded as stable if the height of the sediment is≦1 mm.

b. Rheology:

The rheology of the system is then determined by measuring the apparent viscosity of the suspension at 20° C. with the aid of a type RVT Brookfield viscosimeter equipped with a suitable module. The measurements are made at 10 and 100 rpm, following 2 min of rotation, and are annotated "T4".

The aqueous suspension is regarded as "pumpable" if the apparent viscosity measured at 10 rpm is≦2500 mPa-sec (cp).

This measurement of rheology (Brookfield viscosity) performed after 4 days of storage is repeated after a second cycle of static aging, comprising 40 days at ambient temperature; these latter measurements are annotated "T40".

9.5 wt. % of a hemimaleate comprising 25 units of ethylene oxide and an alkyl group R' having 28 C atoms.

Test No. 5:

A suspension of the invention, containing, as a stabilizer, 0.13 wt. % (dry basis), based on the total weight of the suspension of a water-soluble acrylic copolymer comprised of:

35.5 wt. % of methacrylic acid;

55 wt. % of ethyl acrylate; and 9.5 wt. % of a methacrylate comprising 11 units of ethylene oxide and a linear alkyl group R' having 16–18 C atoms.

Test No. 6:

A suspension according to the invention, containing, as a stabilizer, 0.25 wt. % (dry basis), based on the total weight of the suspension, of a water-soluble acrylic copolymer comprised of:

35.5 wt. % of methacrylic acid;

55 wt. % of ethyl acrylate; and 9.5 wt. % of an acrylurethane comprised of 50 units of ethylene oxide and a nonylphenyl group R'.

The results of the measurements of the Brookfield apparent viscosities at $T_0$ and at $T_4$ and $T_{40}$ days and the height of the sediment in the various tests are summarized in Table I, infra:

TABLE I

| | TEST | MONOMER OF FORMULA I | | | | | | | | DOSE | $T_0$ | $T_4$ | | $T_{40}$ |
|---|---|---|---|---|---|---|---|---|---|---|---|---|---|---|
| | NO. | m | n | p | q | $R_1$ | $R_2$ | R | R' | (*) | η (mPa.s) | η (mPa.s) | D. | η (mPa.s) |
| | 1 | — | — | — | — | — | — | — | — | 0 | 80–75 | INFINITY | 36 mm | INFINITY |
| A.A. | 2 | — | — | — | — | — | — | — | — | 0.30 | 1100–445 | INFINITY | 10 mm | INFINITY |
| A.A. | 3 | — | — | — | — | — | — | — | — | 0.30 | 100–80 | INFINITY | 36 mm | INFINITY |
| INV. | 4 | 0 | 25 | 0 | 1 | — | — | hemimaleate | $C_{28}$-alkyl | 0.13 | 1450–480 | 2080–580 | <1 mm | 1500–500 |
| INV. | 5 | 0 | 11 | 0 | 1 | — | — | methacrylate | cetyl-stearyl | 0.13 | 350–180 | 2200–870 | <1 mm | 1550–525 |
| INV. | 6 | 0 | 50 | 0 | 1 | — | — | acrylurethane | nonyl-phenyl | 0.25 | 1600–580 | 1560–610 | 0 mm | 1200–495 |

(*) In wt. % of the stabilizing agent (dry basis) based on the total weight of the suspension
η (mPa.s) = Brookfield viscosity in mPa.s measured at 10 rpm and at 100 rpm
D. = Height of sediment in millimeters
T. = CONTROL
A.A. = KNOWN COPOLYMER
INV. = INVENTION The various suspensions tested were as follows:

Test No. 1:

Suspension without a stabilizing agent.

Test No. 2:

Suspension according to the known art, containing, as a stabilizer, 0.3 wt. % (dry basis), based on the total weight of the suspension, of a crosslinked polymer comprised of:

40.4 wt. % of methacrylic acid;

59 wt. % of ethyl acrylate; and 0.6 wt. % of a crosslinking agent.

Test No. 3:

A suspension known to the art, containing, as a stabilizer, 0.3 wt. % (dry basis), based on the total weight of the suspension, of an isotridecyl alcohol with 5 mol ethylene oxide.

Test No. 4:

A suspension of the invention, containing, as a stabilizer, 0.13 wt. % (dry basis), based on the total weight of the suspension, of a water-soluble acrylic copolymer comprised of:

35.5 wt. % of methacrylic acid;

55 wt. % of ethyl acrylate; and

It is clear from Table I that only the suspensions of Tests 4–6, those according to the invention, have after 4 and 40 days at ambient temperature, a Brookfield viscosity ≦2500 mPa-sec at 10 rpm and 20° C., and a sediment height≦1 mm. Thus, the aqueous zeolite suspensions of the invention, containing up to 0.3 wt. % (dry basis) based on the total weight of the suspension of a stabilizing agent formed from a copolymer comprised of (a) units of at least one acrylic monomer having a carboxylic acid group, (b) units of at least one acrylic monomer not having a carboxylic acid group, and (c) units of at least one oxyalkylated monomer having ethylenic unsaturation and terminated by a hydrophobic chain, the monomer having formula I, are fluid and stable over time.

EXAMPLE 2

Aqueous zeolite suspensions are prepared by the method of Example 1, starting with the same zeolite suspension, but having, as a stabilizing agent, copolymers with different percentages of units of monomer (c) of formula I.

Accordingly, the tests are as follows:

Test No. 7:

A suspension known to the art, containing, as a stabilizer, 0.30 wt. % (dry basis), based on the total weight of the suspension of an acrylic polymer comprised of:

41 wt. % of methacrylic acid, and 59 wt. % of ethyl acrylate, which acrylic polymer did not contain a monomer (c).

Test No. 8:

A suspension according to the invention, containing, as a stabilizer, 0.20 wt. % (dry basis), based on the total weight of the suspension of an acrylic copolymer comprised of:

a. 35.5 wt. % of methacrylic acid;

b. 60.5 wt. % of ethyl acrylate; and c. 4 wt. % of a methacrylate comprised of 11 units of ethylene oxide and a linear alkyl group R' having 16–18 C atoms.

Test No. 9:

A suspension of the invention, containing, as a stabilizer, 0.16 wt. % (dry basis), based on the total weight of the suspension of an acrylic copolymer comprised of:

a. 35.4 wt. % of methacrylic acid;

b. 59 wt. % of ethyl acrylate; and c. 5.6 wt. % of the methacrylate (c.) of Test No. 8.

Test No. 10:

A suspension of the invention, containing, as a stabilizer, 0.13 wt. % (dry basis), based on the total weight of the suspension, of an acrylic copolymer comprised of:

a. 35.5 wt. % of methacrylic acid;

b. 57 wt. % of ethyl acrylate; and c. 7.5 wt. % of the methacrylate (c.) of Test No. 8.

Test No. 11:

A suspension of the invention, containing, as a stabilizer, 0.13 wt. % (dry basis), based on the total weight of the suspension of an acrylic copolymer comprised of:

a. 35.5 wt. % of methacrylic acid;

b. 52.5 wt. % of ethyl acrylate; and c. 12 wt. % of the methacrylate (c.) of Test No. 8.

Test No. 12:

A suspension of the invention, containing, as a stabilizer, 0.20 wt. % (dry basis), based on the total weight of the suspension of an acrylic copolymer comprised of:

a. 35.5 wt. % of methacrylic acid;

b. 60.5 wt. % of ethyl acrylate; and c. 4 wt. % of a hemimaleate comprised of 25 units of ethylene oxide and an alkyl group R' having 22 C atoms.

Test No. 13:

A suspension of the invention, containing, as a stabilizer, 0.19 wt. % (dry basis), based on the total weight of the suspension, of an acrylic copolymer comprised of:

a. 35.4 wt. % of methacrylic acid;

b. 59 wt. % of ethyl acrylate; and c. 5.6 wt. % of the hemimaleate (c.) of Test No. 12.

Test No. 14:

A suspension of the invention, containing, as a stabilizer, 0.16 wt. % (dry basis), based on the total weight of the suspension, of an acrylic copolymer comprised of:

a. 35.5 wt. % of methacrylic acid;

b. 57 wt. % of ethyl acrylate; and c. 7.5 wt. % of the hemimaleate (c.) of Test No. 12.

Test No. 15:

A suspension of the invention, containing, as a stabilizer, 0.13 wt. % (dry basis), based on the total weight of the suspension of an acrylic copolymer comprised of:

a. 35.5 wt. % of methacrylic acid;

b. 55 wt. % of ethyl acrylate; and c. 9.5 wt. % of the hemimaleate (c.) of Test No. 12.

Table II, infra, summarizes the results of the measurements of the Brookfield apparent viscosities at $T_0$, $T_4$ and $T_{40}$, and the stabilities achieved, under the same conditions as in Example 1.

TABLE II

| | TEST NO. | % OF MONOMER OF FORMULA I | DOSE (*) | $T_0$ η (mPa.s) | $T_4$ η (mPa.s) | D. | $T_{40}$ η (mPa.s) |
|---|---|---|---|---|---|---|---|
| A.A. | 7 | 0 | 0.30 | 350–145 | INFINITY | 38 mm | INFINITY |
| INV. | 8 | 4 | 0.20 | 2100–790 | 2500–790 | 1 mm | 1700–705 |
| INV. | 9 | 5.6 | 0.16 | 550–340 | 2000–820 | <1 mm | 1300–700 |
| INV. | 10 | 7.5 | 0.13 | 400–205 | 2000–720 | <1 mm | 1200–665 |
| INV. | 11 | 12 | 0.13 | 350–180 | 2200–870 | <1 mm | 1550–525 |
| INV. | 12 | 4 | 0.20 | 2500–1080 | 1800–780 | 1 mm | 1050–575 |
| INV. | 13 | 5.6 | 0.19 | 1700–800 | 1600–750 | <1 mm | 2500–1340 |
| INV. | 14 | 7.5 | 0.16 | 2150–1080 | 1700–870 | <1 mm | 2000–890 |
| INV. | 15 | 9.5 | 0.13 | 2300–895 | 2400–1290 | <1 mm | 2400–1000 |

(*) In wt. % of the stabilizing agent (dry basis) based on the total weight of the suspension
η (mPa.s) = Brookfield viscosity in mPa.s measured at 10 rpm and at 100 rpm
D. = Height of sediment in millimeters
A.A. = KNOWN COPOLYMER
INV. = INVENTION It is clear from Table II that the suspensions of Tests 8–15, which suspensions are according to the invention, have, after 4 and 40 days respectively at ambient temperature, a Brookfield viscosity≦2500 mPa-sec at 10 rpm and 20° C., and a sediment height≦1 mm.

Thus, the aqueous zeolite suspensions of the invention, containing a stabilizing agent formed from a copolymer comprised of (a) units of at least one acrylic monomer having a carboxylic acid group, (b) units of at least one acrylic monomer not having a carboxylic acid group, and (c) 3–12 wt. % of units of at least one oxyalkylated monomer having ethylenic unsaturation and terminated by a hydrophobic chain, said monomer having formula I, are fluid and stable over time.

EXAMPLE 3

The aqueous zeolite suspensions are prepared by the method of Example 1, starting with the same zeolite suspension, but having, as a stabilizing agent, copolymers of which the wt. % of methacrylic acid units vary from 20 to 50, and the wt. % of ethyl acrylate units vary from 47–77.

Accordingly, the tests were as follows:

Test No. 16:

A suspension of the invention, containing, as a stabilizer, 0.28 wt. % (dry basis), based on the total weight of the suspension, of an acrylic copolymer comprised of:

a. 20 wt. % of methacrylic acid;

b. 75 wt. % of ethyl acrylate; and c. 5 wt. % of a hemimaleate comprised of 25 units of ethylene oxide and an alkyl group R' having 22 C atoms.

Test No. 17:

A suspension of the invention, containing, as a stabilizer, 0.20 wt. % (dry basis), based an the total weight of the suspension of an acrylic copolymer comprised of:

a. 50 wt. % of methacrylic acid;

b. 47 wt. % of ethyl acrylate; and c. 3 wt. % of the hemimaleate (c.) of Test No. 16.

Table Ill, infra, summarizes the results of the measurements of the Brookfield apparent viscosities at $T_0$ and at $T_4$ and T40 days, and the stabilities achieved (height of the sediment), under the same conditions as in Example 1. in the number of C atoms.

Accordingly, the tests are as follows:

Test No. 18:

A suspension of the invention, containing, as a stabilizer, 0.28 wt. % (dry basis), based on the total weight of the suspension of an acrylic copolymer comprised of:

a. 35.5 wt. % of methacrylic acid;

b. 55 wt. % of ethyl acrylate; and c. 9.5 wt. % of a methacrylate comprised of 23 units of ethylene oxide and a linear alkyl group R' having 12 C atoms.

Test No. 19:

A suspension of the invention, containing, as a stabilizer, 0.13 wt. % (dry basis), based on the total weight of the suspension of an acrylic copolymer comprised of:

a. 35.5 wt. % of methacrylic acid;

b. 55 wt. % of ethyl acrylate; and c. 9.5 wt. % of a methacrylate comprised of 11 units of ethylene oxide and a linear alkyl group R' having 16–18 C atoms.

Test No. 20:

A suspension of the invention, containing, as a stabilizer, 0.13 wt. % (dry basis), based an the total weight of the suspension, of an acrylic copolymer comprised of:

a. 35.5 wt. % of methacrylic acid;

b. 55 wt. % of ethyl acrylate; and c. 9.5 wt. % of a hemimaleate comprised of 25 units of ethylene oxide and an alkyl group R' having 28 C atoms.

TABLE III

| | TEST NO. | % BY WT. OF METHACRYLIC ACID | % BY WT. OF ETHYL ACRYLATE | % BY WT. OF MONOMER OF FORMULA I | DOSE (*) | $T_0$ η (mPa.s) | $T_4$ η (mPa.s) | D | $T_{40}$ η (mPa.s) |
|---|---|---|---|---|---|---|---|---|---|
| INV. | 16 | 20 | 75 | 5 | 0.28 | 2000–820 | 2300–1000 | 1 mm | 2200–910 |
| INV. | 17 | 50 | 47 | 3 | 0.20 | 2400–1100 | 2000–910 | 1 mm | 2300–1000 |

(*) In wt. % of the stabilizing agent (dry basis) based on the total weight of the suspension
η (mPa.s) = Brookfield viscosity in mPa.s measured at 10 rpm and at 100 rpm
D. = Height of sediment in millimeters
INV. = INVENTION It is clear from Table III that the suspensions of Tests 16 and 17, which suspensions are within the scope of the present invention, have, after 4 and 40 days respectively at ambient temperature, a Brookfield viscosity ($T_4$, and $T_{40}$)≦2500 mPa-sec at 10 rpm and 20° C., and a sediment height≦1 mm.

Thus, the aqueous zeolite suspensions of the invention, containing a stabilizing agent formed from a copolymer comprised of (a) 20–50 wt. % of units of at least one acrylic monomer having a carboxylic acid group, (b) 47–77 wt. % of units of at least one acrylic monomer not having a carboxylic acid group, and (c) 3–12 wt. % of units of at least one oxyalkylated monomer having ethylenic unsaturation and terminated by a hydrophobic chain, said monomer having formula I, are fluid and stable over time.

EXAMPLE 4

Aqueous zeolite suspensions are prepared by the method of Example I starting with the same zeolite suspension, but having, as a stabilizing agent, copolymers of which the hydrophobic chain R' of the monomer (c) of formula I varied Test No. 21:

A suspension of the invention, containing, as a stabilizer, 0.13 wt. % (dry basis), based on the total weight of the suspension, of an acrylic copolymer comprised of:

a. 35.5 wt. % of methacrylic acid;

b. 55 wt. % of ethyl acrylate; and c. 9.5 wt. % of a hemimaleate comprised of 20 units of ethylene oxide and an alkyl group R' having 36 C atoms.

Test No. 22:

A suspension of the invention, containing, as a stabilizer, 0.13 wt. % (dry basis), based on the total weight of the suspension, of an acrylic copolymer comprised of:

a. 35.5 wt. % of methacrylic acid;

b. 55 wt. % of ethyl acrylate; and c. 9.5 wt. % of a methacrylate comprised of 70 units of ethylene oxide and a linear alkyl group R' having 16–18 C atoms.

Test No. 23

A suspension of the invention, containing, as a stabilizer, 0.28 wt. % (dry basis), based on the total weight of the suspension, of an acrylic copolymer comprised of:

a. 35.5 wt. % of methacrylic acid;

b. 55 wt. % of ethyl acrylate; and c. 9.5 wt. % of a methacrylate comprised of 6 units of ethylene oxide, 7 units of propylene oxide, and an alkyl group R' having 14 C atoms.

Test No. 24:

A suspension of the invention, containing, as a stabilizer, 0.28 wt. % (dry basis), based on the total weight of the suspension, of an acrylic copolymer comprised of:

a. 35.5 wt. % of methacrylic acid;

b. 62.5 wt. % of ethyl acrylate; and c. 2 wt. % of a methacrylate comprised of 25 units of ethylene oxide and an alkyl group R' having 22 C atoms.

Table IV, infra, summarizes the results of the measurements of the Brookfield apparent viscosities at $T_0$ and at $T_4$ and $T_{40}$ days, and the stabilities achieved (sediment heights), under the some conditions as in Example 1.

TABLE IV

| | TEST | MONOMER OF FORMULA I | | | | | | | | DOSE | $T_0$ | $T_4$ | | $T_{40}$ |
|---|---|---|---|---|---|---|---|---|---|---|---|---|---|---|
| | NO. | m | n | p | q | $R_1$ | $R_2$ | R | R' | (*) | η (mPa.s) | η (mPa.s) | D. | η (mPa.s) |
| INV. | 18 | 0 | 23 | 0 | 1 | — | — | methacrylate | lauryl | 0.28 | 2350–900 | 2450–950 | <1 mm | 2500–1630 |
| INV. | 19 | 0 | 11 | 0 | 1 | — | — | methacrylate | cetyl–stearyl | 0.13 | 350–180 | 2200–870 | <1 mm | 1550–525 |
| INV. | 20 | 0 | 25 | 0 | 1 | — | — | hemimaleate | $C_{28}$–alkyl | 0.13 | 1450–480 | 2080–580 | <1 mm | 1500–500 |
| INV. | 21 | 0 | 20 | 0 | 1 | — | — | hemimaleate | $C_{36}$–alkyl | 0.13 | 300–130 | 1300–360 | <1 mm | 1100–450 |
| INV. | 22 | 0 | 70 | 0 | 1 | — | — | methacrylate | cetyl–stearyl | 0.13 | 1150–635 | 1760–1490 | <1 mm | 1000–1500 |
| INV. | 23 | 0 | 6 | 7 | 1 | — | $CH_3$ | methacrylate | myristyl | 0.28 | 2200–850 | 2500–1000 | <1 mm | 2400–950 |
| INV. | 24 | 0 | 25 | 0 | 1 | — | — | methacrylate | $C_{22}$–alkyl | 0.28 | 2350–700 | 2500–900 | <1 mm | 2000–500 |

(*) In wt. % of the stabilizing agent (dry basis) based on the total weight of the suspension
η (mPa.s) = Brookfield viscosity in mPa.s measured at 10 rpm and at 100 rpm
D. = Height of sediment in millimeters
INV. = INVENTION It is clear from Table IV that the suspensions of Tests 18–24, which suspensions are according to the invention, have after 4 and 40 days respectively at ambient temperature, a Brookfield viscosity ($T_4$ and $T_{40}$)≦2500 mPa-sec at 10 rpm and 20° C. and a sediment height≦1 mm.

Thus, the aqueous zeolite suspensions of the invention, containing a stabilizing agent formed from a copolymer comprised of a. units of at least one acrylic monomer having a carboxylic acid group, b. units of at least one acrylic monomer not having a carboxylic acid group, and c. 2–12 wt. % of units of an oxyalkylated monomer having ethylenic unsaturation and terminated by a hydrophobic chain having at least 12 and as many as 40 C atoms, are fluid and stable over time.

Having now fully described the invention, it will be apparent to one of ordinary skill in the art that many changes and modifications can be made thereto without departing from the spirit or scope of the invention as set forth herein.

What is claimed as new and desired to be secured be Letters Patent in the United States is:

1. A method of preparing a detergent composition comprising:

mixing a stable aqueous zeolite composition with the ingredients of a detergent composition, said stable aqueous zeolite composition comprising:

in addition to one or more natural or synthetic zeolites in water, a stabilizing agent which is a copolymer comprised of:

(a) units of at least one acrylic monomer having a carboxylic acid group selected from the group consisting of (meth)acrylic, itaconic, cinnamic, crotonic, isocrotonic, fumaric, and maleic acids, maleic anhydride, and aconitic, mesaconic, sinapic, undecylenic, angelic, and hydroxyacrylic acids, and derivatives thereof;

(b) units of at least one acrylic acid group selected from the group consisting of the esters, amides, and nitriles of (meth)acrylic, itaconic, cinnamic, crotonic, isocrotonic, fumaric, and maleic, aconitic, mesaconic, sinapic, undecylenic, angelic, and hydroxyacrylic acid, and derivatives thereof, and vinyl acetate, styrene, α-methylstyrene, diisobutylene, vinylpyrrolidone, and vinylcaprolactam;

(c) units of at least one oxyalkylated monomer having ethylenic unsaturation and terminated by a hydrophobic chain and having formula I:

$$R\left[\left(CH_2-\underset{\underset{R_1}{|}}{CH}-O\right)_m\left(CH_2-CH_2-O\right)_n\left(CH_2-\underset{\underset{R_2}{|}}{CH}-O\right)_p\right]_q-R' \quad (I)$$

where m and p represent numbers of oxyalkylene groups, each ≦100;

n represents the number of oxyethylene groups, ≦100;

q represents a number at least equal to 1, such that a(n+m+p)≦100;

$R_1$ represents hydrogen or a methyl group;

$R_2$ represents hydrogen or a methyl group;

R represents an unsaturated polymerizable group selected from the group consisting of vinyl group containing moieties, methacryloyl, maleoyl, itaconoyl, crotonoyl, an unsaturated urethane moiety, hemiester maleoyl, hemiester itaconoyl, $CH_2{=}CHCH_2{-}O{-}$, methacrylamide and unsubstituted methacrylamide; and R represents a hydrophobic group with a fatty chain selected from the groups consisting of alkyl, alkylaryl, aralkyl, and aryl groups, linear or branched, each having 12–40 C atoms.

2. The method of claim 1 wherein the stabilizing agent of said stable aqueous zeolite composition is a copolymer comprised of:

(a) units of at least one acrylic monomer having a carboxylic acid group selected from the group consisting of (meth)acrylic, itaconic, cinnamic, crotonic, isocrotonic, fumaric, and maleic acids, maleic anhydride, and aconitic, mesaconic, sinapic, undecylenic, angelic, and hydroxyacrylic acids, and derivatives thereof;

(b) units of at least one acrylic acid and/or vinylic monomer not having a carboxylic acid from the group consisting of the esters, amides, and nitriles of (meth-)acrylic, itaconic, cinnamic, crotonic, isocrotonic, fumaric, and maleic, aconitic, mesaconic, sinapic, undecylenic, angelic, and hydroxyacrylic acid, and derivatives thereof and vinyl acetate, styrene, α-methylstyrene, diisobutylene, vinylpyrrolidone, and vinylcaprolactam;

(c) units of at least one oxyalkylated monomer having ethylenic unsaturation and terminated by a hydrophobic chain and having formula I:

$$R\left[\left(CH_2-\underset{R_1}{\underset{|}{CH}}-O\right)_m\left(CH_2-CH_2-O\right)_n\left(CH_2-\underset{R_2}{\underset{|}{CH}}-O\right)_p\right]_q-R' \quad (I)$$

where m and p represent numbers of oxyalkylene groups, each ≦100;

n represents the number of oxyethylene groups, ≦100;

q represents the number at least equal to 1, such that q(n+m+p)≦100;

$R_1$ represents hydrogen or a methyl group;

$R_2$ represents hydrogen or a methyl group;

R represents an unsaturated polymerizable group selected from the group consisting of vinyl group containing moieties, methacryloyl, maleoyl, itaconoyl, crotonoyl, an unsaturated urethane moiety, hemiester maleoyl, hemiester itaconoyl, $CH_2{=}CHCH_2{-}O{-}$, methacrylamide and unsubstituted methacrylamido; and R represents a hydrophobic group with a fatty chain selected from the group consisting of alkyl, alkylaryl, aralkyl, and aryl groups, linear or branched, having 26–40 C atoms.

3. The method of claim 2 wherein R of said copolymeric stabilizing agent of said stable aqueous zeolite suspension is an unsaturated urethane selected from the group consisting of (meth)acrylurethane, α,α-dimethyl-m-isopropenyl-benzylurethane and allylurethane.

4. The method of claim 1 wherein the stabilizing agent is a copolymer comprised of (a) 15–75 wt. % of acrylic acid or methacrylic acid units;

(b) 23–83 wt. % of units of a monomer selected from the group consisting of the esters, amides, and nitriles of acrylic and methacrylic acid; and (c) 2–12 wt. % of units of said oxyalkylated monomer.

5. A method of preparing a sequestering agent comprising mixing a stable aqueous zeolite suspension with the ingredients of a composition to be sequestered, said stable aqueous zeolite suspension comprising:

in addition to one or more natural or synthetic zeolites in water, a stabilizing agent which is a copolymer comprised of:

(a) units of at least one acrylic monomer having a carboxylic acid group selected from the group consisting of (meth)acrylic, itaconic, cinnamic, crotonic, isocrotonic, fumaric, and maleic acids, maleic anhydride, and aconitic, mesaconic, sinapic, undecylenic, angelic, and hydroxyacrylic acids, and derivatives thereof;

(b) units of at least one acrylic acid group selected from the group consisting of the esters, amides, and nitriles of (meth)acrylic, itaconic, cinnamic, crotonic, isocrotonic, fumaric, and maleic, aconitic, mesaconic, sinapic, undecylenic, angelic, and hydroxyacrylic acid, and derivatives thereof, and vinyl acetate, styrene, α-methylstyrene, diisobutylene, vinylpyrrolidone, and vinylcaprolactam;

(c) units of at least one oxyalkylated monomer having ethylenic unsaturation and terminated by a hydrophobic chain and having formula I:

$$R\left[\left(CH_2-\underset{R_1}{\underset{|}{CH}}-O\right)_m\left(CH_2-CH_2-O\right)_n\left(CH_2-\underset{R_2}{\underset{|}{CH}}-O\right)_p\right]_q-R' \quad (I)$$

where m and p represent numbers of oxyalkylene groups, each ≦100;

n represents the number of oxyethylene groups, ≦100;

q represents a number at least equal to 1, such that a(n+m+p)≦100;

R represents hydrogen or a methyl group;

$R_2$ represents hydrogen or a methyl group;

R represents an unsaturated polymerizable group selected from the group consisting of vinyl group containing moieties, methacryloyl, maleoyl, itaconoyl, crotonoyl, an unsaturated urethane moiety, hemiester maleoyl, hemiester itaconoyl, $CH_2{=}CHCH_2{-}O{-}$, methacrylamide and unsubstituted methacrylamide; and $R^1$ represents a hydrophobic group with a fatty chain selected from the groups consisting of alkyl, alkylaryl, aralkyl, and aryl groups, linear or branched, each having 12–40 C atoms.

* * * * *